US010738383B2

(12) United States Patent
Dahlenburg et al.

(10) Patent No.: US 10,738,383 B2
(45) **Date of Patent: *Aug. 11, 2020**

(54) METHOD FOR NICKEL-FREE PHOSPHATING METAL SURFACES

(71) Applicant: Chemetall GmbH, Frankfurt (DE)

(72) Inventors: Olaf Dahlenburg, Neu-Isenburg (DE); Frank Hollmann, Leutkirch (DE); Lisa Schmeier, Freigericht-Bernbach (DE)

(73) Assignee: Chemetall GmbH, Frankfurt (DE)

( * ) Notice: Subject to any disclaimer, the term of this patent is extended or adjusted under 35 U.S.C. 154(b) by 279 days.

This patent is subject to a terminal disclaimer.

(21) Appl. No.: 15/562,970

(22) PCT Filed: Apr. 7, 2016

(86) PCT No.: PCT/EP2016/057622

§ 371 (c)(1),
(2) Date: Sep. 29, 2017

(87) PCT Pub. No.: WO2016/162423

PCT Pub. Date: Oct. 13, 2016

(65) Prior Publication Data

US 2018/0112313 A1 Apr. 26, 2018

(30) Foreign Application Priority Data

Apr. 7, 2015 (DE) ..... 10 2015 206 145

(51) Int. Cl.
*C23C 22/83* (2006.01)
*C23C 22/40* (2006.01)
(Continued)

(52) U.S. Cl.
CPC ..... *C23C 22/83* (2013.01); *C23C 22/07* (2013.01); *C23C 22/182* (2013.01); *C23C 22/34* (2013.01);
(Continued)

(58) Field of Classification Search
CPC ..... C23C 22/82–83
See application file for complete search history.

(56) References Cited

U.S. PATENT DOCUMENTS 6,090,224 A * 7/2000 Wichelhaus et al. ... C23C 22/83 148/256
6,447,662 B1 9/2002 Brouwer et al.

FOREIGN PATENT DOCUMENTS

DE 19511573 A1 10/1996
DE 19834796 A1 2/2000
(Continued)

OTHER PUBLICATIONS

International Search Report for International Application No. PCT/EP2016/057622, dated Jun. 22, 2016, 4 pages.
(Continued)

*Primary Examiner* — Lois L Zheng
(74) *Attorney, Agent, or Firm* — Armstrong Teasdale LLP

(57) ABSTRACT

Described herein is a method for substantially nickel-free phosphating of a metallic surface, wherein a metallic surface, optionally after cleaning and/or activation, is first treated with an acidic aqueous phosphating composition that includes zinc ions, manganese ions, and phosphate ions, and is optionally rinsed and/or dried, and is thereafter treated with an aqueous after-rinse composition that includes at least one kind of metal ion selected from the group consisting of the ions of molybdenum, copper, silver, gold, palladium, tin, antimony, titanium, zirconium, and hafnium and/or at least one polymer selected from the group consisting of the polymer classes of the polyamines, polyethyleneamines, polyanilines, polyimines, polyethyleneimines, polythiophenes, and polypyroles and also mixtures and copolymers thereof, with both the phosphating composition and the after-rinse composition being substantially nickel-free.

19 Claims, 3 Drawing Sheets

(51) Int. Cl.

| | |
|---|---|
| ***C23C 22/18*** | (2006.01) |
| ***C23C 22/36*** | (2006.01) |
| ***C25D 13/12*** | (2006.01) |
| ***C25D 13/20*** | (2006.01) |
| ***C23C 22/34*** | (2006.01) |
| ***C25D 5/48*** | (2006.01) |
| ***C23C 22/07*** | (2006.01) |
| ***C23C 22/82*** | (2006.01) |
| *C23C 22/00* | (2006.01) |

(52) U.S. Cl.

CPC ..... *C23C 22/362* (2013.01); *C23C 22/364* (2013.01); *C23C 22/365* (2013.01); *C23C 22/82* (2013.01); *C25D 5/48* (2013.01); *C25D 13/12* (2013.01); *C25D 13/20* (2013.01); *C23C 2222/20* (2013.01)

(56) References Cited

FOREIGN PATENT DOCUMENTS

| | | | |
|---|---|---|---|
| EP | 0531575 | A1 | 3/1993 |
| WO | 9533083 | A1 | 12/1995 |
| WO | 0138605 | A2 | 5/2001 |
| WO | 03027203 | A2 | 4/2003 |
| WO | 2005061761 | A1 | 7/2005 |
| WO | 2016/162422 | A1 | 10/2016 |

OTHER PUBLICATIONS

International Search Report and Written Opinion for PCT Patent Application No. PCT/EP2016/057622, dated Jun. 30, 2016, 11 pages of ISR and WO and 10 pages of English Translation.

* cited by examiner

METHOD FOR NICKEL-FREE PHOSPHATING METAL SURFACES

CROSS-REFERENCE TO RELATED APPLICATIONS

This application is a U.S. National Phase Application of International Patent Application No. PCT/EP2016/057622, filed Apr. 7, 2016, which claims the benefit of priority to German Application No. 102015206145.0, filed Apr. 7, 2015, the entire contents of which are hereby incorporated by reference herein.

BACKGROUND

The present invention relates to a method for substantially nickel-free phosphating of a metallic surface, to a corresponding phosphating composition, and also to a correspondingly phosphate-coated metallic surface.

Phosphate coatings on metallic surfaces are known from the prior art. Such coatings serve to prevent corrosion of the metallic surfaces and also, furthermore, as adhesion promoters for subsequent coating films.

Such phosphate coatings are employed in particular in the areas of the automobile industry and also of general industry.

The subsequent coating films, as well as powder coatings and wet paints, are, in particular, cathodically deposited electrocoat materials (CEC). Since the deposition of CEC requires a flow of current between metallic surface and treatment bath, it is important to set a defined electrical conductivity in the phosphate coating in order to ensure efficient and uniform deposition.

Phosphate coatings, therefore, are customarily applied using a nickel-containing phosphating solution. The nickel deposited in this process, elementally or as an alloy constituent, e.g., Zn/Ni, provides appropriate conductivity of the coating in the course of the subsequent electrocoating.

On account of their high toxicity and environmental harmfulness, however, nickel ions are no longer a desirable constituent of treatment solutions, and ought therefore as far as possible be avoided or at least reduced in terms of their amount.

The use of nickel-free or low-nickel phosphating solutions is indeed known in principle. It is limited, however, to particular substrates such as steel.

The stated nickel-free or low-nickel systems, moreover, may result in poor corrosion values and coating adhesion values under prevailing CEC deposition conditions, owing to a nonideal substrate surface.

SUMMARY

It was an object of the present invention, therefore, to provide a method with which metallic surfaces can be subjected to substantially nickel-free phosphating, with these surfaces being comparable or virtually comparable in terms of their electrochemical properties to the metallic surfaces treated with nickel-containing phosphating solutions, and with which more particularly the aforementioned disadvantages of the prior art are avoided.

This object is achieved by a method according to claim 1, a phosphating composition according to claim 21, and a phosphate-coated metallic surface according to claim 23.

In the method of the invention for substantially nickel-free phosphating of a metallic surface, a metallic surface, optionally after cleaning and/or activation, is first treated with an acidic aqueous phosphating composition which comprises zinc ions, manganese ions, and phosphate ions, and is optionally rinsed and/or dried, and is thereafter treated with an aqueous after-rinse composition which comprises at least one kind of metal ions selected from the group consisting of the ions of molybdenum, copper, silver, gold, palladium, tin, antimony, titanium, zirconium, and hafnium and/or at least one polymer selected from the group consisting of the polymer classes of the polyamines, polyethyleneamines, polyanilines, polyimines, polyethyleneimines, polythiophenes, and polypryroles and also mixtures and copolymers thereof, with both the phosphating composition and the after-rinse composition being substantially nickel-free.

DETAILED DESCRIPTION

Figure 1:
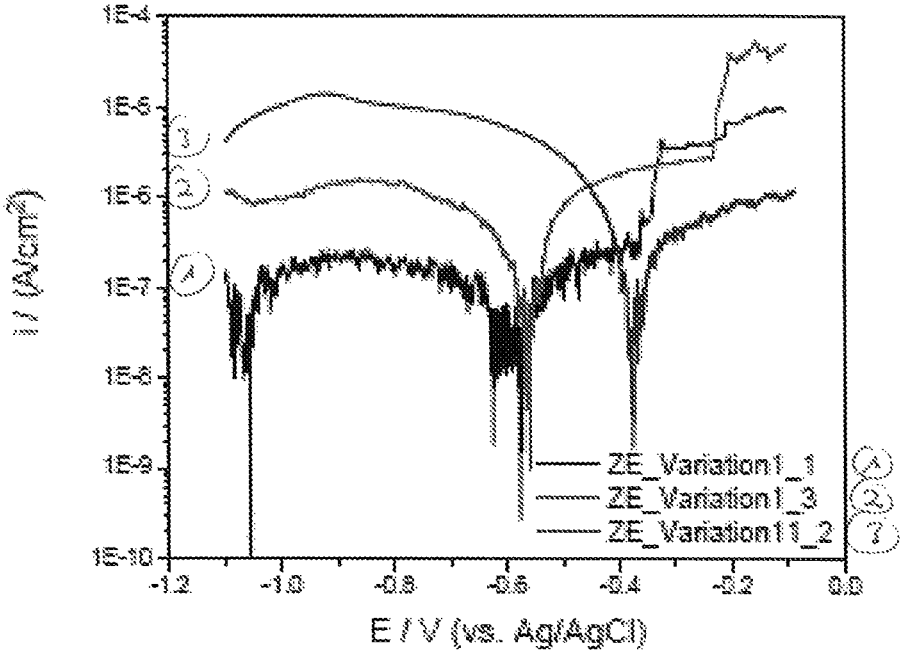
FIGS. 1-6 are graphs illustrating current density measured over a voltage applied to test plates prepared as described in the Examples of the present disclosure.

Definitions:

The method of the invention can be used to treat either an uncoated metallic surface or else a metallic surface which has already been conversion coated. Reference below to a "metallic surface" is therefore always to be taken as also including an already conversion-coated metallic surface.

An "aqueous composition" for the purposes of the present invention is a composition which comprises at least partly, preferably predominantly water as its solvent. In addition to dissolved constituents, it may also comprise dispersed—i.e., emulsified and/or suspended—constituents.

For the purposes of the present invention, "phosphate ions" also refers to hydrogenphosphate, dihydrogenphosphate and phosphoric acid. Moreover, the intention is to encompass pyrophosphoric acid and polyphosphoric acid and all of their partially and fully deprotonated forms.

A "metal ion" for the purposes of the present invention is alternatively a metal cation, a complex metal cation, or a complex metal anion.

Where a composition contains less than 0.3 g/l of nickel ions, it is considered for the purposes of the present invention to be "substantially nickel-free".

The metallic surface preferably comprises steel, a hot-dip galvanized system, an electrolytically galvanized system, aluminum, or alloys thereof such as Zn/Fe or Zn/Mg, for example. In the case of the hot-dip galvanized systems and electrolytically galvanized systems, they are in each case more particularly a system of this kind on steel. The metallic surface more particularly is at least partially galvanized.

The method of the invention is especially suitable for multimetal applications.

If a metallic surface is to be coated and does not represent a fresh hot-dip galvanized system, it is advantageous, prior to the treatment with the phosphating composition, for the metallic surface first to be cleaned, and more particularly degreased, in an aqueous cleaning composition. For this purpose, in particular, an acidic, neutral, alkaline or strongly alkaline cleaning composition may be used, but optionally also, additionally, an acidic or neutral pickling composition.

An alkaline or strongly alkaline cleaning composition has proven especially advantageous here.

Besides at least one surfactant, the aqueous cleaning composition may optionally also comprise a cleaning-agent builder and/or other additions such as complexing agents. Also possible is the use of an activating cleaner.

After the cleaning/pickling, there is advantageously at least one rinsing of the metallic surface with water, in which case an additive in solution in water, such as a nitrite or surfactant, for example, may optionally also be added to the water.

Prior to the treatment of the metallic surface with the phosphating composition, it is advantageous to treat the metallic surface with an activating composition. The purpose of the activating composition is to deposit a multiplicity of ultrafine phosphate particles as seed crystals on the metallic surface. These crystals help to form a phosphate layer, more particularly a crystalline phosphate layer, having an extremely high number of densely disposed, fine phosphate crystals, or a largely impervious phosphate layer, in the subsequent method step, in contact with the phosphating composition—preferably without rinsing in-between.

Activating compositions contemplated include, in particular, acidic or alkaline compositions based on titanium phosphate or zinc phosphate.

It may, however, also be advantageous to add activating agents, especially titanium phosphate or zinc phosphate, to the cleaning composition—in other words, to carry out cleaning and activation in one step.

The acidic aqueous phosphating composition comprises zinc ions, manganese ions, and phosphate ions.

The phosphating composition here may be obtained from a concentrate by dilution with a suitable solvent, preferably with water, by a factor of between 1 and 100, preferably between 5 and 50, and, where necessary, addition of a pH-modifying substance.

The phosphating composition preferably comprises the following components in the following preferred and more preferred concentration ranges:

| | | |
|---|---|---|
| Zn | 0.3 to 3.0 g/l | 0.5 to 2.0 g/l |
| Mn | 0.3 to 2.0 g/l | 0.5 to 1.5 g/l |
| Phosphate (calculated as $P_2O_5$) | 8 to 25 g/l | 10 to 18 g/l |
| Free fluoride | 30 to 250 mg/l | 50 to 180 mg/l |
| Complex fluoride (calculated, e.g., as $SiF_6^{2-}$ and/or $BF_4^-$) | 0 to 5 g/l | 0.5 to 3 g/l |

With regard to the manganese ions, however, a concentration in the range from 0.3 to 2.5 g/l has already proven advantageous, and in terms of the free fluoride, a concentration in the range from 10 to 250 mg/l.

The complex fluoride preferably comprises tetrafluoroborate ($BF_4^-$) and/or hexafluorosilicate ($SiF_6^{2-}$).

Particularly in the treatment of aluminum and/or galvanized material, the presence in the phosphating composition of complex fluoride and also simple fluoride, sodium fluoride for example, is an advantage.

$Al^{3+}$ in phosphating systems is a bath poison and may be removed from the system by complexing with fluoride, in the form of cryolite, for example. Complex fluorides are added to the bath as "fluoride buffers", since otherwise the fluoride content would rapidly drop and coating would no longer take place. Fluoride, then, supports the formation of the phosphate layer and consequently leads indirectly to an improvement in coating adhesion and also corrosion control, as well. On galvanized material, furthermore, complex fluoride helps to prevent defects such as specks.

In the treatment of aluminum, in particular, it is also advantageous if the phosphating composition contains Fe(III). Preference is given in this case to an Fe(III) content in the range from 0.001 to 0.2 g/l, more preferably from 0.005 to 0.1 g/l, and very preferably from 0.01 to 0.05 g/l.

The phosphating composition further preferably comprises at least one accelerator selected from the group consisting of the following compounds in the following preferred and more preferred concentration ranges:

| | | |
|---|---|---|
| Nitroguanidine | 0.2 to 3.0 g/l | 0.2 to 1.5 5 g/l |
| $H_2O_2$ | 10 to 100 mg/l | 15 to 50 mg/l |
| Nitroguanidine/$H_2O_2$ | 0.2 to 2.0 g/l/10 to 50 mg/l | 0.2 to 1.5 g/l/15 to 30 mg/l |
| Nitrite | 30 to 300 mg/l | 90 to 150 mg/l |
| Hydroxylamine | 0.1 to 5 g/l | 0.4 to 3 g/l |

With regard to the nitroguanidine, however, a concentration in the range from 0.1 to 3.0 g/l has already proven advantageous, with regard to the $H_2O_2$ a concentration in the range from 5 to 200 mg/l.

Very preferably the at least one accelerator is $H_2O_2$.

Preferably, however, the phosphating composition contains less than 1 g/l, more preferably less than 0.5 g/l, very preferably less than 0.1 g/l and especially preferably less than 0.01 g/l of nitrate.

The reason for this is that in the case of a galvanized surface, in particular, the nitrate in the phosphating composition causes an additional acceleration in the layer-forming reaction, resulting in lower coat weights, but in particular reduces the incorporation of the manganese into the crystal. If the manganese content of the phosphate coating is too low, however, its alkali resistance suffers.

The alkali resistance in turn plays a critical part in the event of subsequent cathodic electrocoat deposition. In this process, electrolytic dissociation of water occurs at the substrate surface: hydroxide ions are formed. As a result, the pH at the substrate interface goes up. It is indeed only by this means that the electrocoat material is able to agglomerate and be deposited. However, the elevated pH may also damage the crystalline phosphate layer.

The phosphating composition preferably has a temperature in the range from 30 to 55° C.

The phosphating composition may be characterized, furthermore, by the following preferred and more preferred parameter ranges:

| | | |
|---|---|---|
| FA | 0.3 to 2.0 | 0.7 to 1.6 |
| FA (dil.) | 0.5 to 8 | 1 to 6 |
| TAF | 12 to 28 | 22 to 26 |
| TA | 12 to 45 | 18 to 35 |
| A value | 0.01 to 0.2 | 0.03 to 0.15 |
| Temperature ° C. | 30 to 50° C. | 35 to 45° C. |

With regard to the FA parameter, however, a value in the range from 0.2 to 2.5 has already proven advantageous, and with regard to the temperature a value in the range from 30 to 55° C.

In this listing, "FA" stands for Free acid, "FA (dil.)" stands for Free acid (diluted), "TAF" stands for Total acid, Fischer, "TA" stands for Total acid, and "A value" stands for Acid value.

These parameters are determined here as follows:

Free acid (FA):

For determination of the free acid, 10 ml of the phosphating composition are pipetted into a suitable vessel, such as a 300 ml Erlenmeyer flask. If the phosphating composition contains complex fluorides, an additional 2-3 g of potassium chloride are added to the sample. Titration then takes place, using a pH meter and an electrode, with 0.1 M NaOH to a pH of 3.6. The quantity of 0.1 M NaOH consumed in this titration, in ml per 10 ml of the phosphating composition, gives the value of the Free acid (FA) in points.

Free acid (diluted) (FA (dil.)):

For determination of the free acid (diluted), 10 ml of the phosphating composition are pipetted into a suitable vessel, such as a 300 ml Erlenmeyer flask. Subsequently 150 ml of DI water are added. Titration takes place, using a pH meter and an electrode, with 0.1 M NaOH to a pH of 4.7. The quantity of 0.1 M NaOH consumed in this titration, in ml per 10 ml of the dilute phosphating composition, gives the value of the Free acid (diluted) (FA (dil.)) in points. From the difference relative to the Free acid (FA) it is possible to determine the amount of complex fluoride. If this difference is multiplied by a factor of 0.36, the result is the amount of complex fluoride as $SiF_6^{2-}$ in g/l.

Total acid, Fischer (TAF):

Following determination of the free acid (diluted), the dilute phosphating composition, following addition of potassium oxalate solution, is titrated, using a pH meter and an electrode, with 0.1 M NaOH to a pH of 8.9. The consumption of 0.1 M NaOH in this procedure, in ml per 10 ml of the dilute phosphating composition, gives the Total acid, Fischer (TAF) in points. If this figure is multiplied by 0.71, the result is the total amount of phosphate ions, calculated as $P_2O_5$ (see W. Rausch: "Die Phosphatierung von Metallen". Eugen G. Leuze-Verlag 2005, 3rd edition, pp. 332 ff).

Total acid (TA):

The Total acid (TA) is the sum of the divalent cations present and also free and bonded phosphoric acids (the latter being phosphates). It is determined by the consumption of 0.1 M NaOH, using a pH meter and an electrode. For this purpose, 10 ml of the phosphating composition are pipetted into a suitable vessel, such as a 300 ml Erlenmeyer flask, and diluted with 25 ml of DI water. This is followed by titration with 0.1 M NaOH to a pH of 9. The consumption during this procedure, in ml per 10 ml of the dilute phosphating composition, corresponds to the points number of the Total acid (TA).

Acid value (A value):

The Acid value (A value) represents the ratio FA:TAF and is obtained by dividing the value for the Free acid (FA) by the value for the Total acid, Fischer (TAF).

The further improvement in the coating adhesion, especially on hot-dip galvanized surfaces, as a result of the setting of an acid value in the range from 0.03 to 0.065, more particularly in the range from 0.04 to 0.06, was surprising.

It has surprisingly emerged that, particularly in the case of steel or a hot-dip galvanized system as metallic surface, a phosphating composition temperature of less than 45° C., preferably in the range between 35 and 45° C., leads to further-improved corrosion and coating adhesion values.

The phosphating composition is substantially nickel-free. It contains preferably less than 0.1 g/l and more preferably less than 0.01 g/l of nickel ions.

The metallic surface is treated with the phosphating composition for preferably 30 to 480 seconds, more preferably for 60 to 300 seconds, and very preferably for 90 to 240 seconds, preferably by means of dipping or spraying.

The treatment of the metallic surface with the phosphating composition produces the following preferred and particularly preferred zinc phosphate coat weights on the metallic surface, depending on the surface treated (determined by x-ray fluorescence analysis (XRF)):

| Surface treated | Zinc phosphate coat weight ($g/m^2$) | |
|---|---|---|
| Steel | 0.5 to 6 | 1 to 5 |
| Hot-dip galvanized system | 1.0 to 6 | 1.5 to 5 |
| Electrolytically galvanized system | 1.0 to 6 | 1.5 to 5 |
| Aluminum | 0.5 to 6 | 1 to 5 |

After the treatment with the phosphating composition, the metallic surface is preferably rinsed, being rinsed more preferably with fully deionized water or mains water. The metallic surface is optionally dried prior to treatment with the after-rinse composition.

According to the method of the invention, the metallic surface already treated with the phosphating composition, i.e., already phosphate-coated, is further treated with an aqueous after-rinse composition.

This after-rinse composition may be obtained from a concentrate by dilution with a suitable solvent, preferably with water, by a factor of between 1 and 1000, preferably between 5 and 500, and where necessary by addition of a pH-modifying substance.

According to one embodiment, the after-rinse composition comprises at least one kind of metal ions selected from the group consisting of the ions of the following metals in the following preferred, more preferred, and especially preferred concentration ranges (all calculated as the metal in question):

| | | | |
|---|---|---|---|
| Mo | 1 to 1000 mg/l | 10 to 500 mg/l | 20 to 225 mg/l |
| Cu | 1 to 1000 mg/l | 100 to 500 mg/l | 150 to 225 mg/l |
| Ag | 1 to 500 mg/l | 5 to 300 mg/l | 20 to 150 mg/l |
| Au | 1 to 500 mg/l | 10 to 300 mg/l | 20 to 200 mg/l |
| Pd | 1 to 200 mg/l | 5 to 100 mg/l | 15 to 60 mg/l |
| Sn | 1 to 500 mg/l | 2 to 200 mg/l | 3 to 100 mg/l |
| Sb | 1 to 500 mg/l | 2 to 200 mg/l | 3 to 100 mg/l |
| Ti | 20 to 500 mg/l | 50 to 300 mg/l | 50 to 150 mg/l |
| Zr | 20 to 500 mg/l | 50 to 300 mg/l | 50 to 150 mg/l |
| Hf | 20 to 500 mg/l | 50 to 300 mg/l | 50 to 150 mg/l |

The metal ions present in the after-rinse solution are deposited either in the form of a salt containing the metal cation in question (e.g., molybdenum or tin), preferably in at least two oxidation states—more particularly in the form of an oxide hydroxide, a hydroxide, a spinel or a defect spinel—or in elemental form on the surface to be treated (e.g., copper, silver, gold or palladium).

According to one preferred embodiment, the metal ions are molybdenum ions. They are added preferably as molybdate, more preferably as ammonium heptamolybdate, and very preferably as ammonium heptamolybdate×$7H_2O$ to the after-rinse composition. The molybdenum ions may also be added as sodium molybdate.

Molybdenum ions may alternatively be added, for example, in the form of at least one salt containing molybdenum cations, such as molybdenum chloride, to the after-rinse composition, and then oxidized to molybdate by a suitable oxidizing agent, examples being the accelerators described earlier on above. In such a case, the after-rinse composition itself comprises a corresponding oxidizing agent.

With further preference the after-rinse composition comprises molybdenum ions in combination with copper ions, tin ions or zirconium ions.

With particular preference it comprises molybdenum ions in combination with zirconium ions and also, optionally, a polymer or copolymer, selected more particularly from the group consisting of the polymer classes of the polyamines, polyethyleneamines, polyanilines, polyimines, polyethyleneimines, polythiophenes, and polypryroles, and also mixtures and copolymers thereof, and polyacrylic acid, the amount of molybdenum ions and zirconium ions being in each case in the range from 10 to 500 mg/l (calculated as metal).

The amount of molybdenum ions here is preferably in the range from 20 to 225 mg/l, more preferably from 50 to 225 mg/l, and very preferably from 100 to 225 mg/l, and the amount of zirconium ions is preferably in the range from 50 to 300 mg/l, more preferably from 50 to 150 mg/l.

According to a further preferred embodiment, the metal ions are copper ions. The after-rinse solution preferably comprises these ions in that case in a concentration from 100 to 500 mg/l, more preferably from 150 to 225 mg/l.

According to a further embodiment, the after-rinse composition of the invention comprises at least one polymer selected from the group consisting of the polymer classes of the polyamines, polyethyleneamines, polyanilines, polyimines, polyethyleneimines, polythiophenes, and polypryroles, and also mixtures and copolymers thereof.

The at least one polymer is present preferably in a concentration in the range from 0.1 to 5 g/l, more preferably from 0.1 to 3 g/l, more preferably from 0.3 to 2 g/l, and very preferably in the range from 0.5 to 1.5 g/l (calculated as pure polymer).

Polymers used are preferably cationic polymers, especially polyamines, polyethyleneamines, polyimines and/or polyethyleneimines. Particularly preferred for use is a polyamine and/or polyimine, very preferably a polyamine.

According to a third embodiment, the after-rinse composition of the invention comprises at least one kind of metal ions selected from the group consisting of the ions of molybdenum, copper, silver, gold, palladium, tin, antimony, titanium, zirconium, and hafnium, and at least one polymer selected from the group consisting of the polymer classes of the polyamines, polyethyleneamines, polyanilines, polyimines, polyethyleneimines, polythiophenes, and polypryroles, and also mixtures and copolymers thereof, in each case in the following preferred, more preferred, and especially preferred concentration ranges (polymer calculated as pure polymer, and metal ions calculated as the metal in question).

| | | | |
|---|---|---|---|
| Mo | 1 to 1000 mg/l | 10 to 500 mg/l | 20 to 225 mg/l |
| Cu | 1 to 1000 mg/l | 100 to 500 mg/l | 150 to 225 mg/l |
| Ag | 1 to 500 mg/l | 5 to 300 mg/l | 20 to 150 mg/l |
| Au | 1 to 500 mg/l | 10 to 300 mg/l | 20 to 200 mg/l |
| Pd | 1 to 200 mg/l | 5 to 100 mg/l | 15 to 60 mg/l |
| Sn | 1 to 500 mg/l | 2 to 200 mg/l | 3 to 100 mg/l |
| Sb | 1 to 500 mg/l | 2 to 200 mg/l | 3 to 100 mg/l |
| Ti | 20 to 500 mg/l | 50 to 300 mg/l | 50 to 150 mg/l |
| Zr | 20 to 500 mg/l | 50 to 300 mg/l | 50 to 150 mg/l |
| Hf | 20 to 500 mg/l | 50 to 300 mg/l | 50 to 150 mg/l |
| Polymer | 0.1 g/l to 3 g/l | 0.3 g/l to 2 g/l | 0.5 to 1.5 g/l |

According to one preferred embodiment, the at least one polymer is a cationic polymer, more particularly a polyamine and/or polyimine, and the metal ions are copper ions, molybdenum ions and/or zirconium ions, in each case in the following preferred, more preferred, and especially preferred concentration ranges (polymer calculated as pure polymer, and metal ions calculated as the metal in question).

| | | | |
|---|---|---|---|
| Mo | 1 to 1000 mg/l | 10 to 500 mg/l | 20 to 225 mg/l |
| Cu | 1 to 1000 mg/l | 100 to 500 mg/l | 150 to 225 mg/l |

-continued

| | | | |
|---|---|---|---|
| Zr | 20 to 500 mg/l | 50 to 300 mg/l | 50 to 150 mg/l |
| cat. Polymer | 0.1 g/l to 3 g/l | 0.3 g/l to 2 g/l | 0.5 g/l to 1.5 g/l |

The after-rinse composition—especially if the metallic surface is aluminum or an aluminum alloy—preferably comprises additionally 20 to 500 mg/l, more preferably 50 to 300 mg/l and very preferably 50 to 150 mg/l of Ti, Zr and/or Hf in complexed form (calculated as the metal). The complexes in question are preferably fluoro complexes. Moreover, the after-rinse composition comprises preferably 10 to 500 mg/l, more preferably 15 to 100 mg/l, and very preferably 15 to 50 mg/l of free fluoride.

With particular preference the after-rinse composition comprises Zr in complexed form (calculated as the metal) and at least one kind of metal ions selected from the group consisting of the ions of molybdenum, copper, silver, gold, palladium, tin and antimony, preferably of molybdenum.

An after-rinse composition comprising Ti, Zr and/or Hf in complexed form preferably further comprises at least one organosilane and/or at least one hydrolysis product thereof, in other words an organosilanol and/or at least one condensation product thereof, in other words an organosiloxane/polyorganosiloxane, in a concentration range of 5 to 200 mg/l, more preferably of 10 to 100 mg/l and very preferably of 20 to 80 mg/l (calculated as Si).

The at least one organosilane preferably contains at least one amino group. More preferably the organosilane is one which can be hydrolyzed to an aminopropylsilanol and/or to 2-aminoethyl-3-aminopropylsilanol, and/or is a bis (trimethoxysilylpropyl)amine.

The pH of the after-rinse composition is preferably in the acidic range, more preferably in the range from 3 to 5, very preferably in the range from 3.5 to 5.

Surprisingly it has been found that lowering the pH promotes the deposition of molybdenum ions on the phosphate-coated metallic surface. In the case of an after-rinse solution comprising molybdenum ions, therefore, the pH is preferably 3.5 to 4.5 and more preferably 3.5 to 4.0.

The after-rinse composition is substantially nickel-free. It contains preferably less than 0.1 g/l and more preferably less than 0.01 g/l of nickel ions.

The after-rinse composition preferably has a temperature in the range from 15 to 40° C. The metallic surface is treated with the after-rinse composition preferably for 10 to 180 seconds, more preferably for 20 to 150 seconds and especially preferably for 30 to 120 seconds, preferably by means of dipping or spraying.

The invention further relates to a phosphate-coated metallic surface which is obtainable by the process of the invention.

The process of the invention allows the electrical conductivity of the phosphate-coated metal surface to be adjusted in a specific way, by producing defined pores in the phosphate layer. The conductivity in this case may alternatively be greater than, equal to or less than that of a corresponding metal surface provided with a nickel-containing phosphate coating.

The electrical conductivity of the phosphate-coated metal surface, adjusted with the process of the invention, may be influenced by varying the concentration of a given metal ion and/or polymer in the after-rinse solution.

Then, cathodically, an electrocoat material may be deposited on the phosphate-coated metallic surface—also treated with the after-rinse composition—, and a coating system applied.

The metallic surface in this case, after the treatment with the after-rinse composition, is optionally first rinsed, preferably with deionized water, and optionally dried.

In the text below, the intention is to illustrate the present invention by means of working examples, which should not be understood as imposing any restriction, and comparative examples.

COMPARATIVE EXAMPLE 1

A test plate made of electrolytically galvanized steel (ZE) was coated using a phosphating solution at 53° C. which contained 1.3 g/l of Zn, 1 g/l of Mn, 13 g/l of $PO_4^{3-}$ (calculated as $P_2O_5$), 3 g/l of $NO_3^-$ and also 1 g/l of nickel. No after-rinse was performed. The current density i in A/cm$^2$ was then measured over the voltage E in V applied against a silver/silver chloride (Ag/AgCl) electrode (see FIG. 1: ZE_Variation11_2: curve 3). Measurement took place by means of linear sweep voltammetry (potential range: −1.1 to −0.2 $V_{ref}$; scan rate: 1 mV/s).

In all of the inventive and comparative examples, the measured current density i is dependent on the electrical conductivity of the conversion coating. The rule is as follows: the higher the measured current density i, the higher the electrical conductivity of the conversion coating as well. Direct measurement of the electrical conductivity in μS/cm, of the kind possible in liquid media, cannot be carried out in the case of conversion coatings.

Presently, therefore, the current density i measured for a nickel-containing conversion coating always serves as a reference point for statements made about the electrical conductivity of a given conversion coating.

The indication "1E" in FIGS. 1 to 4 always stands for "10". For example, therefore, "1E−4" means "$10^{-4}$".

COMPARATIVE EXAMPLE 2

A test plate as per comparative example 1 was coated using a nickel-free phosphating solution at 53° C., containing 1.3 g/l of Zn, 1 g/l of Mn, 16 g/l of $PO_4^{3-}$ (calculated as $P_2O_5$) and 2 g/l of $NO_3^-$, without an after-rinse, and subsequently the current density i was measured over the voltage E as in comparative example 1 (see FIG. 1. ZE_Variation1_1: curve 1; ZE_Variation1_3: curve 2).

As can be seen from FIG. 1, the rest potential of the nickel-free system (comparative example 2) is shifted to the left relative to that of the nickel-containing system (comparative example 1). The electrical conductivity is lower as well: the "arms" of curve 1 and also of curve 2 are located in each case below curve 3, i.e., toward lower current densities.

COMPARATIVE EXAMPLE 3

A test plate as per comparative example 1 was coated using a nickel-free phosphating solution as per comparative example 2. The test plate thus coated was subsequently treated with an after-rinse solution containing about 120 mg/l of $ZrF_6^{2-}$ (calculated as Zr), with a pH of about 4. The current density i was measured over the voltage E as in comparative example 1 (see FIG. 2. ZE_Variation6_1: curve 1; ZE_Variation6_2: curve 2). Comparison is made with comparative example 1 (FIG. 2: ZE_Variation11_2: curve 3).

Figure 2:
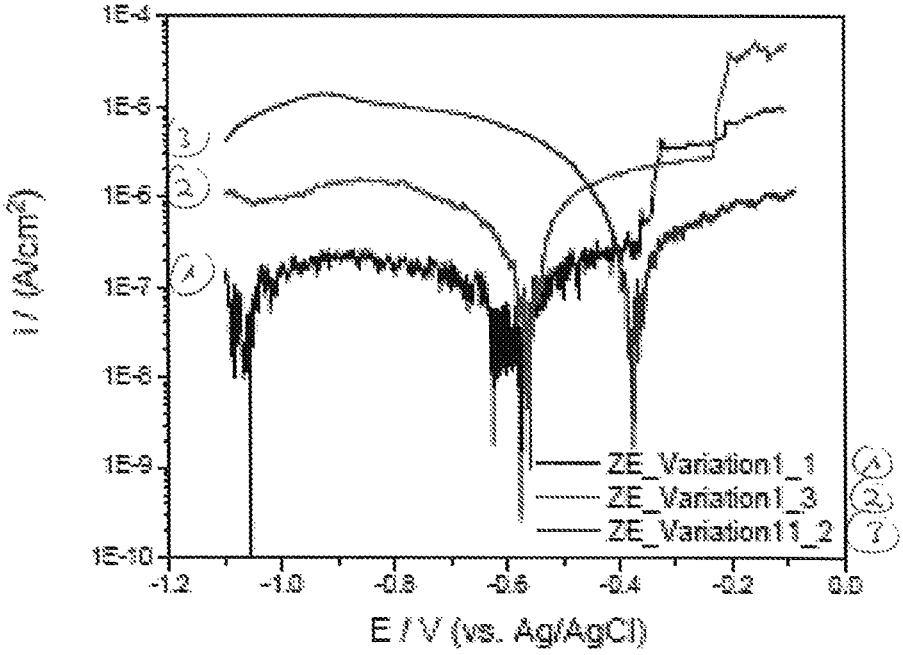

As can be seen from FIG. 2, the rest potential of the nickel-free system when using a $ZrF_6^{2-}$-containing after-rinse solution (comparative example 3) is shifted to the left relative to that of the nickel-containing system (comparative example 1). The electrical conductivity as well is lower for the stated nickel-free system (cf. the observations in relation to comparative example 2).

EXAMPLE 1

A test plate as per comparative example 1 was coated using a nickel-free phosphating solution as per comparative example 2. The test plate thus coated was subsequently treated with an after-rinse solution containing about 220 mg/l of copper ions, with a pH of about 4. The current density i was measured over the voltage E as in comparative example 1 (see FIG. 3. ZE_Variation2_1: curve 1; ZE_Variation2_2: curve 2). Comparison is again made with comparative example 1 (FIG. 3: ZE_Variation11_2: curve 3).

Figure 3:
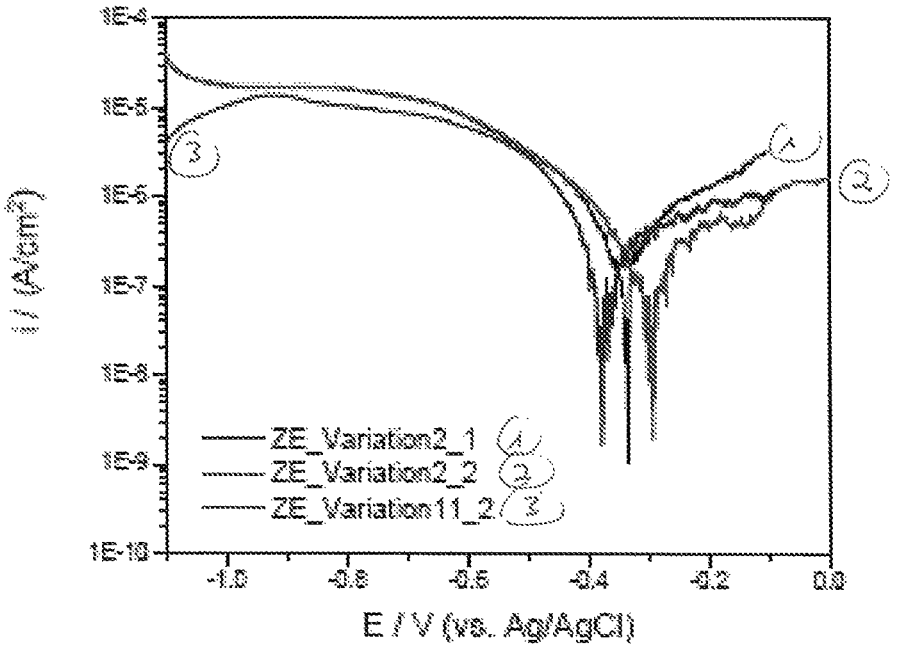

As can be seen from FIG. 3, the rest potential of the nickel-free system when using an after-rinse solution containing copper ions (example 1) corresponds to that of the nickel-containing system (comparative example 1). The conductivity of this nickel-free system is slightly increased relative to that of the nickel-containing system.

EXAMPLE 2

A test plate as per comparative example 1 was coated using a nickel-free phosphating solution as per comparative example 2. The test plate thus coated was subsequently treated with an after-rinse solution which contained about 1 g/l (calculated on the basis of the pure polymer) of electrically conductive polyamine (Lupamin® 9030, manufacturer BASF) and having a pH of about 4. The current density i was measured over the voltage E as in comparative example 1 (see FIG. 4. ZE_Variation3_1: curve 1; ZE_Variation3_2: curve 2). Comparison is made with comparative example 1 (FIG. 4: ZE_Variation11_2: curve 3).

Figure 4:
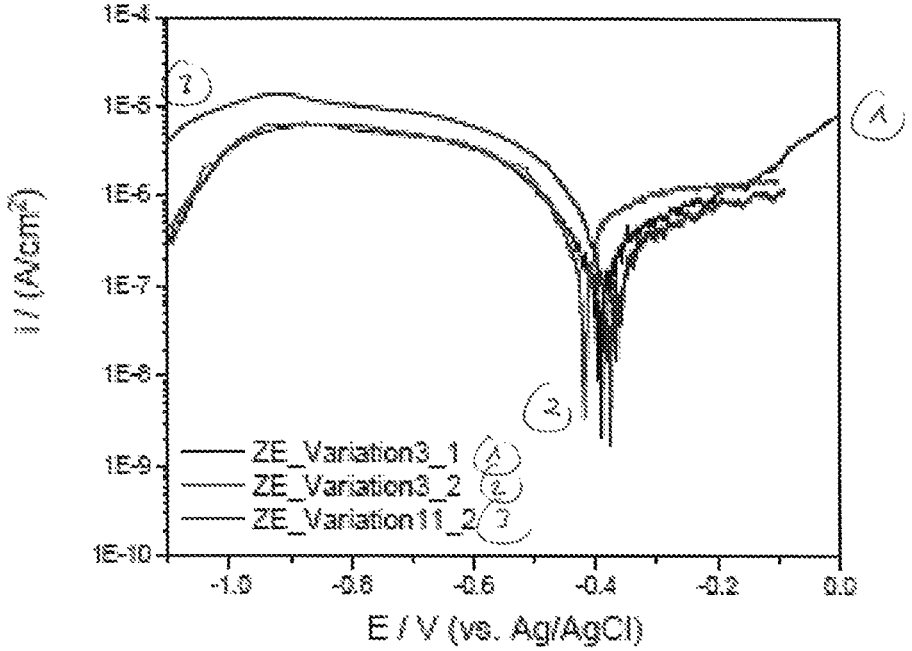

As can be seen from FIG. 4, the rest potential of the nickel-free system when using an after-rinse solution containing an electrically conductive polymer (example 2) corresponds to that of the nickel-containing system (comparative example 1). The electrical conductivity of the nickel-free system is slightly reduced relative to its nickel-containing counterpart.

COMPARATIVE EXAMPLE 4

A test plate made of hot-dip galvanized steel (EA) was coated using a phosphating solution containing 1 g/l of nickel as per comparative example 1. The test plate thus coated was subsequently treated with an after-rinse solution containing about 120 mg/l of $ZrF_6^{2-}$ (calculated as Zr), with a pH of about 4, and subsequently the current density i in A/cm$^2$ was measured over the voltage E in V applied against a silver/silver chloride (Ag/AgCl) electrode (see FIG. 5: EA 173: curve 1). The measurement was made by linear sweep voltammetry.

COMPARATIVE EXAMPLE 5

A test plate as per comparative example 4 was coated using a nickel-free and nitrate-free phosphating solution at 35° C., containing 1.2 g/l of Zn, 1 g/l of Mn and 16 g/l of $PO_4^{3-}$ (calculated as $P_2O_5$), without an after-rinse, and subsequently the current density i was measured over the voltage E in accordance with comparative example 3 (see FIG. 5. EA 167: curve 3; EA 167 2: curve 2).

Figure 5:
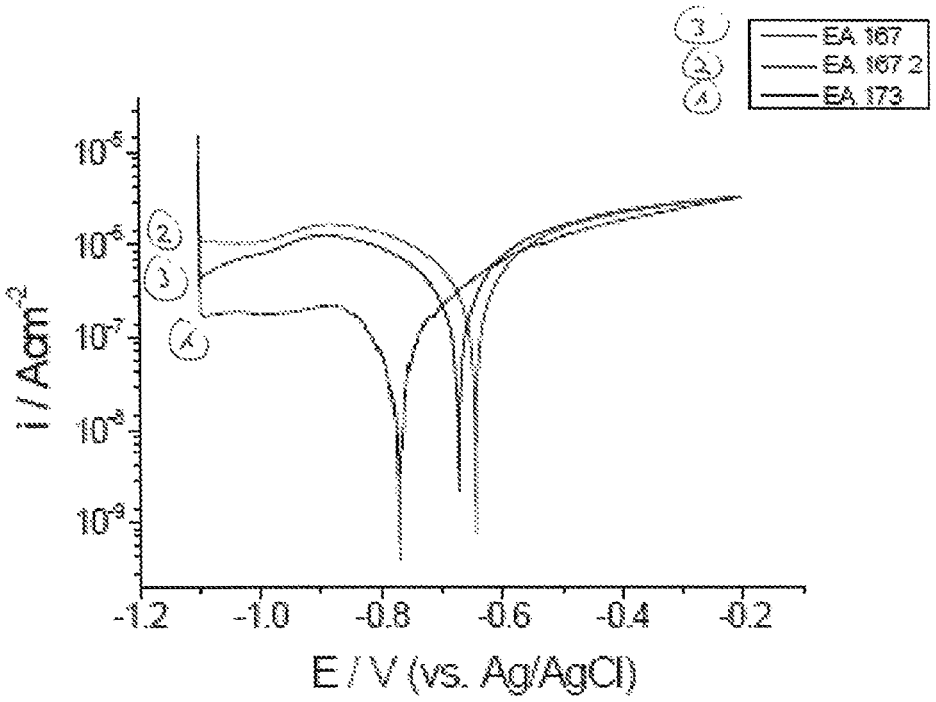

As can be seen from FIG. 5, the rest potential of the nickel-free system (comparative example 5) is shifted to the right relative to that of the nickel-containing system (comparative example 4). The electrical conductivity for the nickel-containing system is much lower, this being attributable to the passivation by means of the $ZrF_6^{2-}$-containing after-rinse solution.

EXAMPLE 3

A test plate as per comparative example 4 was coated using a nickel-free phosphating solution as per comparative example 2. The test plate thus coated was subsequently treated with an after-rinse solution containing about 120 mg/l of $ZrF_6^{2-}$ (calculated as Zr) and 220 mg/l of molybdenum ions, with a pH of about 4. The current density i was measured over the voltage E as per comparative example 1 (see FIG. 6. EA 178: curve 3; EA 178 2: curve 2). Comparison is made with comparative example 3 (FIG. 6: EA 173: curve 1).

Figure 6:
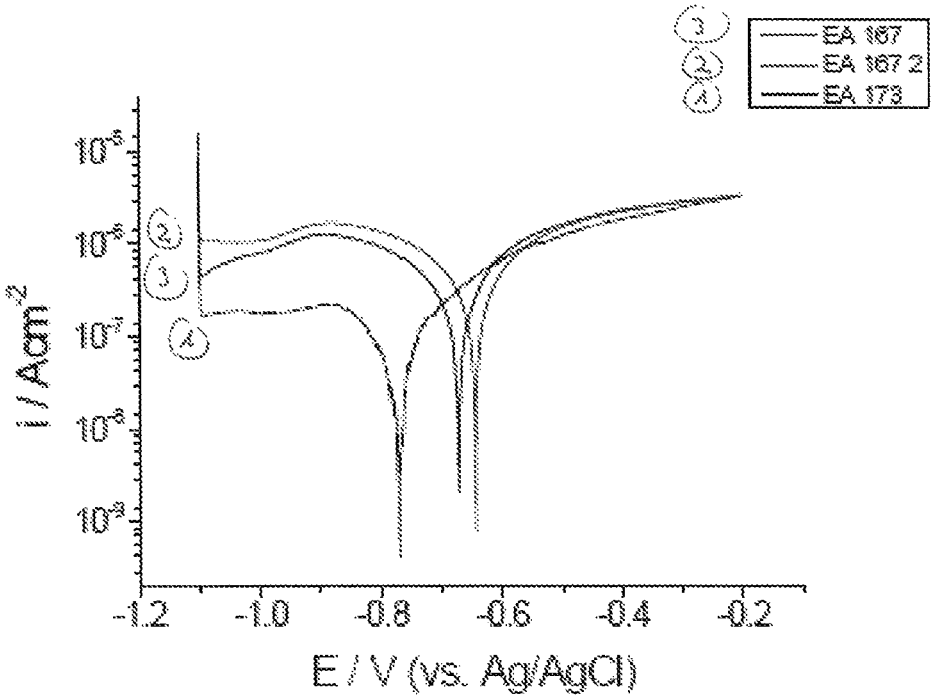

As can be seen from FIG. 6, the rest potential of the nickel-free system when using an after-rinse solution containing $ZrF_6^{2-}$ and molybdenum ions (example 3) corresponds to that of the nickel-containing system (comparative example 4). Through the addition of molybdenum ions (example 3) to the $ZrF_6^{2-}$-containing after-rinse solution (comparative example 4), it was possible to increase significantly the conductivity on the substrate surface.

After phosphating had taken place, test plates as per comparative examples 1 to 3 (CE1 to CE3) and also examples 1 and 2 (E1 and E2) were coated with a cathodic electrocoat material and also with a standard automotive coating system (filler, basecoat, clearcoat) and then subjected to a DIN EN ISO 2409 cross-cut test. Tested in each case were 3 metal panels, before and after exposure for 240 hours to condensation water (DIN EN ISO 6270-2 CH). The corresponding results are found in Tab. 1. In these results, a cross-cut outcome of 0 is the best, one of 5 the poorest result. Results of 0 and 1 here are of comparable quality.

TABLE 1

| (Comparative) Example | Cross-cut before exposure (0-5) | Cross-cut after exposure (0-5) |
|---|---|---|
| CE1 | 0/0/0 | 1/1/0 |
| CE2 | 1/0/0 | 3/1/0 |
| CE3 | 0/0/1 | 1/5/4 |
| E1 | 1/0/0 | 0/0/1 |
| E2 | 1/1/1 | 1/1/1 |

Tab. 1 shows the poor results of CE2 and especially of CE3, in each case after exposure, whereas E1 (copper ions) and E2 (electroconductive polyamine) afford results which are good, and are at least comparable to CE1 (nickel-containing phosphating).

COMPARATIVE EXAMPLE 6

A test plate made of hot-dip galvanized steel (EA) was coated using a phosphating solution at 53° C. containing 1.1 g/l of Zn, 1 g/l of Mn, 13.5 g/l of $PO_4^{3-}$ (calculated as $P_2O_5$), 3 g/l of $NO_3^-$ and also 1 g/l of nickel, with nitrite acceleration (about 90 mg/l of nitrite). The test plate thus coated was subsequently treated with an after-rinse solution containing about 120 mg/l of $ZrF_6^{2-}$ (calculated as Zr), with a pH of about 4.

COMPARATIVE EXAMPLE 7

A test plate as per comparative example 6 was coated using a nickel-free phosphating solution at 35° C. containing 1.1 g/l of Zn, 1 g/l of Mn, 17 g/l of $PO_4^{3-}$ (calculated as $P_2O_5$) and 0.5 g/l of $NO_3^-$, with nitrite acceleration (about 90 mg/l of nitrite). The test plate thus coated was subsequently treated with an after-rinse solution containing about 120 mg/l of $ZrF_6^{2-}$ (calculated as Zr) and 220 mg/l of molybdenum ions with a pH of about 4.

EXAMPLE 4

A test plate as per comparative example 6 was coated using a nickel-free and nitrate-free phosphating solution at 35° C. containing 1.1 g/l of Zn, 1 g/l of Mn and 17 g/l of $PO_4^{3-}$ (calculated as $P_2O_5$), with nitrite acceleration (about 90 mg/l of nitrite). The test plate thus coated was subsequently treated with an after-rinse solution containing about 120 mg/l of $ZrF_6^{2-}$ (calculated as Zr) and 220 mg/l of molybdenum ions with a pH of about 4.

COMPARATIVE EXAMPLE 8

A test plate as per comparative example 6 was coated using a nickel-free phosphating solution at 35° C. containing 1.1 g/l of Zn, 1 g/l of Mn, 17 g/l of $PO_4^{3-}$ (calculated as $P_2O_5$) and 0.5 g/l of $NO_3^-$, with peroxide acceleration (about 80 mg/l of $H_2O_2$). The test plate thus coated was subsequently treated with an after-rinse solution containing about 120 mg/l of $ZrF_6^{2-}$ (calculated as Zr) and 220 mg/l of molybdenum ions with a pH of about 4.

EXAMPLE 5

A test plate as per comparative example 6 was coated using a nickel-free and nitrate-free phosphating solution at 35° C. containing 1.1 g/l of Zn, 1 g/l of Mn and 17 g/l of $PO_4^{3-}$ (calculated as $P_2O_5$), with peroxide acceleration (about 80 mg/l of $H_2O_2$). The test plate thus coated was subsequently treated with an after-rinse solution containing about 120 mg/l of $ZrF_6^{2-}$ (calculated as Zr) and 220 mg/l of molybdenum ions with a pH of about 4.

After phosphating had taken place, test plates as per comparative examples 6 to 8 (CE6 to CE8) and also examples 4 and 5 (E4 and E5) were coated with a cathodic electrocoat material and also with a standard automotive coating system (filler, basecoat, clearcoat) and then subjected to a DIN EN ISO 2409 cross-cut test. Tested in each case were 3 metal panels, before and after exposure for 240 hours to condensation water (DIN EN ISO 6270-2 CH). The corresponding results are found in Tab. 2.

TABLE 2

| (Comparative) Example | Cross-cut before exposure (0-5) | Cross-cut after exposure (0-5) |
|---|---|---|
| CE6 | 0/0/0 | 0/0/0 |
| CE7 | 5/5/5 | 5/5/5 |
| E4 | 1/0/0 | 1/0/1 |

TABLE 2-continued

| (Comparative) Example | Cross-cut before exposure (0-5) | Cross-cut after exposure (0-5) |
|---|---|---|
| CE8 | 5/4/5 | 5/5/5 |
| E5 | 0/1/0 | 1/1/1 |

Tab. 2 shows the poor results of CE7 (nitrite-accelerated) and also CE8 (peroxide-accelerated) in comparison to CE6, whereas E4 (nitrite-accelerated) and E5 (peroxide-accelerated) yield good results—comparable with those for CE6 (nickel-containing phosphating).

COMPARATIVE EXAMPLE 9

A test plate made of hot-dip galvanized steel (EA) was coated using a phosphating solution at 53° C. containing 1.1 g/l of Zn, 1 g/l of Mn, 13.5 g/l of $PO_4^{3-}$ (calculated as $P_2O_5$), 3 g/l of $NO_3^-$ and also 1 g/l of nickel, with nitrite acceleration (about 90 mg/l of nitrite). The test plate thus coated was subsequently treated with an after-rinse solution containing about 120 mg/l of $ZrF_6^{2-}$ (calculated as Zr), with a pH of about 4.

EXAMPLE 6

A test plate as per comparative example 9 was coated using a nickel-free and nitrate-free phosphating solution at 35° C. containing 1.1 g/l of Zn, 1 g/l of Mn and 17 g/l of $PO_4^{3-}$ (calculated as $P_2O_5$), with peroxide acceleration (about 80 mg/l of $H_2O_2$). The test plate thus coated was subsequently treated with an after-rinse solution containing about 120 mg/l of $ZrF_6^{2-}$ (calculated as Zr) and 220 mg/l of molybdenum ions with a pH of about 4.

COMPARATIVE EXAMPLE 10

A test plate made of bright steel was coated using a phosphating solution at 53° C. containing 1.1 g/l of Zn, 1 g/l of Mn, 13.5 g/l of $PO_4^{3-}$ (calculated as $P_2O_5$), 3 g/l of $NO_3^-$ and also 1 g/l of nickel, with nitrite acceleration (about 90 mg/l of nitrite). The test plate thus coated was subsequently treated with an after-rinse solution containing about 120 mg/l of $ZrF_6^{2-}$ (calculated as Zr), with a pH of about 4.

EXAMPLE 7

A test plate as per comparative example 10 was coated using a nickel-free and nitrate-free phosphating solution at 35° C. containing 1.1 g/l of Zn, 1 g/l of Mn and 17 g/l of $PO_4^{3-}$ (calculated as $P_2O_5$), with peroxide acceleration (about 80 mg/l of $H_2O_2$). The test plate thus coated was subsequently treated with an after-rinse solution containing about 120 mg/l of $ZrF_6^{2-}$ (calculated as Zr) and 220 mg/l of molybdenum ions with a pH of about 4.

COMPARATIVE EXAMPLE 11

A test plate made of electrolytically galvanized steel (ZE) was coated using a phosphating solution at 53° C. containing 1.1 g/l of Zn, 1 g/l of Mn, 13.5 g/l of $PO_4^{3-}$ (calculated as $P_2O_5$), 3 g/l of $NO_3^-$ and also 1 g/l of nickel, with nitrite acceleration (about 90 mg/l of nitrite). The test plate thus coated was subsequently treated with an after-rinse solution containing about 120 mg/l of $ZrF_6^{2-}$ (calculated as Zr), with a pH of about 4.

EXAMPLE 8

A test plate as per comparative example 11 was coated using a nickel-free and nitrate-free phosphating solution at 35° C. containing 1.1 g/l of Zn, 1 g/l of Mn and 17 g/l of $PO_4^{3-}$ (calculated as $P_2O_5$), with peroxide acceleration (about 80 mg/l of $H_2O_2$). The test plate thus coated was subsequently treated with an after-rinse solution containing about 120 mg/l of $ZrF_6^{2-}$ (calculated as Zr) and 220 mg/l of molybdenum ions with a pH of about 4.

After phosphating had taken place, test plates as per comparative examples 9 to 11 (CE9 to CE11) and also examples 6 to 8 (E6 to E8) were coated with a cathodic electrocoat material and also with a standard automotive paint system (filler, basecoat, clearcoat) and subjected to the cross-cut test described earlier on above for CE6 to CE8, E4 and E5. The results are summarized in Tab. 3.

Furthermore, said test plates were subjected to a VDA test (VDA 621-415), which determined the coating undermining (U) in mm and also the coating detachment after stone chipping (DIN EN ISO 20567-1, Method C). A result of 0 is the best here, a result of 5 poorest after stone chipping has taken place. A figure up to 1.5 is considered good. The results are likewise summarized in Tab. 3.

TABLE 3

| (Comparative) Example | Cross-cut before exposure (0-5) | Cross-cut after exposure (0-5) | VDA U in mm | VDA Stone chipping |
|---|---|---|---|---|
| CE9 | 0/0/0 | 0/0/0 | 0.3/0.3/0.5 | 0.5/0.5/0.5 |
| E6 | 0/0/1 | 1/1/1 | 0.8/1/1.3 | 1/1/0.5 |
| CE10 | 0/0/0 | 0/0/0 | 0.5/0.5/0.3 | 1/1/1 |
| E7 | 0/0/0 | 0/0/0 | 0.8/0.8/0.8 | 1/0.5/1 |
| CE11 | 0/0/0 | 0/0/0 | 0.8/0.8/0.5 | 0.5/0.5/0.5 |
| E8 | 0/0/0 | 1/0/1 | 1.5/1.8/1.3 | 1/1/1 |

Tab. 3 shows the good results which can be achieved with the nickel-free process of the invention both on hot-dip galvanized steel (E6) and on bright steel (E7) and also on electrolytically galvanized steel (E8). These results are comparable in each case to the nickel-containing process (cf. E6 with CE9, E7 with CE10, and E8 with CE11).

COMPARATIVE EXAMPLE 12

A test plate made of hot-dip galvanized steel (EA) was coated using a phosphating solution at 53° C. containing 1.1 g/l of Zn, 1 g/l of Mn, 13.5 g/l of $PO_4^{3-}$ (calculated as $P_2O_5$), 3 g/l of $NO_3^-$ and also 1 g/l of nickel, with nitrite acceleration (about 90 mg/l of nitrite). The test plate thus coated was subsequently treated with an after-rinse solution containing about 120 mg/l of $ZrF_6^{2-}$ (calculated as Zr), with a pH of about 4.

EXAMPLE 9

A test plate as per comparative example 12 was coated using a nickel-free and nitrate-free phosphating solution at 35° C. containing 1.1 g/l of Zn, 1 g/l of Mn and 17 g/l of $PO_4^{3-}$ (calculated as $P_2O_5$), with peroxide acceleration (about 80 mg/l of $H_2O_2$). The test plate thus coated was subsequently treated with an after-rinse solution containing about 120 mg/l of $ZrF_6^{2-}$ (calculated as Zr) and 220 mg/l of molybdenum ions with a pH of about 4.

EXAMPLE 10

A test plate as per comparative example 12 was coated using a nickel-free and nitrate-free phosphating solution at 45° C. containing 1.2 g/l of Zn, 1 g/l of Mn and 13 g/l of $PO_4^{3-}$ (calculated as $P_2O_5$), with peroxide acceleration (about 50 mg/l of $H_2O_2$). The test plate thus coated was subsequently treated with an after-rinse solution containing about 120 mg/l of $ZrF_6^{2-}$ (calculated as Zr) and 220 mg/l of molybdenum ions with a pH of about 4.

COMPARATIVE EXAMPLE 13

A test plate made of bright steel was coated using a phosphating solution as per comparative example 12, with nitrite acceleration (about 90 mg/l of nitrite). The test plate thus coated was subsequently treated with an after-rinse solution containing about 120 mg/l of $ZrF_6^{2-}$ (calculated as Zr), with a pH of about 4.

EXAMPLE 11

A test plate as per comparative example 13 was coated using a phosphating solution as per example 9, with peroxide acceleration (about 80 mg/l of $H_2O_2$). The test plate thus coated was subsequently treated with an after-rinse solution containing about 120 mg/l of $ZrF_6^{2-}$ (calculated as Zr) and 220 mg/l of molybdenum ions, with a pH of about 4.

EXAMPLE 12

A test plate as per comparative example 13 was coated using a phosphating solution as per example 10, with peroxide acceleration (about 50 mg/l of $H_2O_2$). The test plate thus coated was subsequently treated with an after-rinse solution containing about 120 mg/l of $ZrF_6^{2-}$ (calculated as Zr) and 220 mg/l of molybdenum ions, with a pH of about 4.

COMPARATIVE EXAMPLE 14

A test plate made of AA6014 S was coated using a phosphating solution as per comparative example 12, with nitrite acceleration (about 90 mg/l of nitrite). The test plate thus coated was subsequently treated with an after-rinse solution containing about 120 mg/l of $ZrF_6^{2-}$ (calculated as Zr), with a pH of about 4.

EXAMPLE 13

A test plate as per comparative example 14 was coated using a phosphating solution as per example 9, with peroxide acceleration (about 80 mg/l of $H_2O_2$). The test plate thus coated was subsequently treated with an after-rinse solution containing about 120 mg/l of $ZrF_6^{2-}$ (calculated as Zr) and 220 mg/l of molybdenum ions, with a pH of about 4.

EXAMPLE 14

A test plate as per comparative example 14 was coated using a phosphating solution as per example 10, with peroxide acceleration (about 50 mg/l of $H_2O_2$). The test plate thus coated was subsequently treated with an after-rinse solution containing about 120 mg/l of $ZrF_6^{2-}$ (calculated as Zr) and 220 mg/l of molybdenum ions, with a pH of about 4.

After phosphating had taken place, test plates as per comparative example 12 to 14 (CE12 to CE14) and also examples 9 to 14 (E9 to E14) were coated with a cathodic electrocoat material and also with a standard automotive coating system (filler, basecoat, clearcoat).

The test plates of comparative examples 12 and 13 (CE12 and CE13) and also of examples 9 to 12 (E9 to E12) were subjected to the VDA test described earlier on above. The results are summarized in Tab. 4.

The test plates of comparative example 14 (CE14) and also of examples 13 and 14 (E13 and E14), in contrast, were subjected to a 240-hour CASS test in accordance with DIN EN ISO 9227. The results are summarized in Tab. 5.

TABLE 4

| (Comparative) | VDA | |
|---|---|---|
| Example | U in mm | Stone chipping |
| CE12 | 0.1/0.1/0.3 | 0.5/0.5/0.5 |
| E9 | 0.8/0.8/0.3 | 1.5/1.5/1.5 |
| E10 | 0.3/0.3/0.3 | 1/1/1 |
| CE13 | 0.3/0.5/0.5 | 0.5/0.5/0.5 |
| E11 | 1/0.5/1.3 | 1/1.5/1.5 |
| E12 | 1.3/1.3/1 | 1/1/1 |

TABLE 5

| (Comparative) Example | CASS |
|---|---|
| CE14 | 0.8/0.8/0.8 |
| E13 | 1.5/1.5/1.5 |
| E14 | 1.5/1.5/1.3 |

EXAMPLE 15

A test plate made of hot-dip galvanized steel (EA) was coated using a nickel-free and also nitrate-free phosphating solution at 35° C., containing 1.1 g/l of Zn, 1 g/l of Mn and 17 g/l of $PO_4^{3-}$ (calculated as $P_2O_5$), with peroxide acceleration (about 80 mg/l of $H_2O_2$). The acid value of the phosphating solution was adjusted to 0.07. The test plate thus coated was subsequently treated with an after-rinse solution containing about 120 mg/l of $ZrF_6^{2-}$ (calculated as Zr) and 220 mg/l of molybdenum ions with a pH of about 4.

EXAMPLE 16

A test plate made of hot-dip galvanized steel (EA) was coated using a nickel-free and also nitrate-free phosphating solution at 35° C., containing 1.1 g/l of Zn, 1 g/l of Mn and 17 g/l of $PO_4^{3-}$ (calculated as $P_2O_5$), with peroxide acceleration (about 80 mg/l of $H_2O_2$). The acid value of the phosphating solution was adjusted to 0.05. The test plate thus coated was subsequently treated with an after-rinse solution containing about 120 mg/l of $ZrF_6^{2-}$ (calculated as Zr) and 220 mg/l of molybdenum ions with a pH of about 4.

After phosphating had taken place, test plates as per examples 15 and 16 (E15 and E16) were coated with a cathodic electrocoat material and also with a standard automotive coating system (filler, basecoat, clearcoat), and were subsequently subjected—as described earlier on above—to a cross-cut test before and after exposure to condensation water for 240 hours. The results are summarized in Tab. 6.

| Example | Cross-cut before exposure (0-5) | Cross-cut after exposure (0-5) |
|---|---|---|
| E15 | 0/0/1 | 3/2/1 |
| E16 | 0/1/0 | 1/1/1 |

It can be seen from Tab. 6 that the cross-cut results after exposure to condensation water can be improved significantly through the lowering of the acid value (E16).

The invention claimed is:

1. A method for substantially nickel-free phosphating of a metallic surface, the method comprising:

treating a metallic surface with an acidic aqueous phosphating composition that comprises zinc ions, manganese ions, and phosphate ions; and treating the metallic surface with an aqueous after-rinse composition that comprises ions of molybdenum, wherein the ions of molybdenum are selected from the group consisting of molybdate ions, and wherein both the phosphating composition and the after-rinse composition are substantially nickel-free.

2. The method according to claim 1, wherein the metallic surface is at least partly galvanized.

3. The method according to claim 1, wherein the phosphating composition comprises 0.3 to 3.0 g/l of zinc ions, 0.3 to 2.0 g/l of manganese ions, and 8 to 25 g/l of phosphate ions.

4. The method according to claim 1, wherein the phosphating composition further comprises 30 to 250 mg/l of free fluoride.

5. The method according to claim 1, wherein the phosphating composition further comprises 0.5 to 3 g/l of complex fluoride.

6. The method according to claim 5, wherein the complex fluoride is at least one of tetrafluoroborate ($BF_4^-$) and hexafluorosilicate ($SiF_6^{2-}$).

7. The method according to claim 1, wherein the phosphating composition further comprises Fe(III).

8. The method according to claim 1, wherein the phosphating composition further comprises at least one accelerator selected from the group consisting of nitroguanidine, $H_2O_2$, nitrite, and hydroxylamine.

9. The method according to claim 8, wherein the at least one accelerator is $H_2O_2$.

10. The method according to claim 1, wherein the phosphating composition contains less than 1 g/l of nitrate.

11. The method according to claim 1, wherein the phosphating composition has a Free acid in a range from 0.3 to 2.0, a diluted Free acid in a range from 0.5 to 8, a Total acid, Fischer in a range from 12 to 28, a Total acid in a range from 12 to 45, and an Acid value in a range from 0.01 to 0.2.

12. The method according to claim 1, wherein the phosphating composition has an Acid value in a range from 0.03 to 0.065.

13. The method according to claim 1, wherein the phosphating composition has a temperature in a range from 30 to 50° C.

14. The method according to claim 1, wherein the after-rinse composition further comprises zirconium ions.

15. The method according to claim 14, wherein the after-rinse composition comprises 20 to 225 mg/l of the molybdenum ions and 50 to 300 mg/l of the zirconium ions.

16. The method according to claim 1, wherein the pH of the after-rinse composition is 3.5 to 4.5.

17. The method according to claim 1, wherein the after-rinse composition further comprises copper ions.

18. The method according to claim 17, wherein the after-rinse composition comprises 100 to 500 mg/l of the copper ions.

19. The method according to claim 1, wherein the after-rinse composition further comprises at least one of a polyamine and polyimine.

* * * * *